US007494378B1

(12) United States Patent
Peng

(10) Patent No.: US 7,494,378 B1
(45) Date of Patent: Feb. 24, 2009

(54) BOARD-TO-BOARD CONNECTOR ASSEMBLY

(75) Inventor: Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/073,474

(22) Filed: Mar. 6, 2008

(51) Int. Cl.
*H01R 13/648* (2006.01)

(52) U.S. Cl. ..... 439/607

(58) Field of Classification Search ..... 439/607, 439/608, 108
See application file for complete search history.

(56) References Cited

U.S. PATENT DOCUMENTS 5,256,085 A * 10/1993 Tan et al. ..... 439/607
5,599,207 A * 2/1997 Lai ..... 439/567
6,183,294 B1 * 2/2001 Fan et al. ..... 439/567

* cited by examiner

*Primary Examiner*—Phuong K Dinh
(74) *Attorney, Agent, or Firm*—Rosenberg, Klein & Lee

(57) ABSTRACT

A board-to-board connector assembly includes a receptacle and a plug. The receptacle has a receptacle housing. A plurality of first terminals are configured in the receptacle housing. A first shielding shell is mounted to two opposite ends of the receptacle housing. A second shielding shell is mounted to two opposite sides of the receptacle housing for contacting with the first shielding shell. The plug has a plug housing received in the receptacle housing. A plurality of second terminals are configured in the plug housing. A third shielding shell is mounted to the plug housing and contacts with the second shielding shell.

17 Claims, 6 Drawing Sheets

BOARD-TO-BOARD CONNECTOR ASSEMBLY

BACKGROUND OF THE INVENTION

1. Field of the Invention

The present invention generally relates to a board-to-board connector assembly, and more particularly to a board-to-board connector assembly with electromagnetic interference shielding shells.

2. The Related Art

Generally, a board-to-board connector assembly includes a receptacle and a plug which are respectively mounted to a pair of spaced parallel printed circuit boards for electrically interconnecting the printed circuit boards. The board-to-board connector assembly mainly transmits low frequency signals or low speed signals.

However, with the development of electronic field, the board-to-board connector assembly is required to transmit some high-frequency signals or high-speed signals. Thus, some electromagnetic interference signals are inevitably generated. The above-mentioned board-to-board connector assembly has no electromagnetic interference shielding shells. Therefore, the electromagnetic interference generated by the high-frequency signals or high-speed signals affects the signal transmission between the printed circuit boards.

SUMMARY OF THE INVENTION

An object of the present invention is to provide a board-to-board connector assembly with electromagnetic interference shielding shells for shielding an electromagnetic interference generated by transmitting some high-frequency signals or high-speed signals so as to ensure a credible signal transmission between a female and a male printed circuit boards.

The board-to-board connector assembly adapted for electrically interconnecting a female and a male printed circuit boards includes a receptacle and a plug. The receptacle is adapted to be mounted to the female printed circuit board and has a receptacle housing, a plurality of first terminals, a first shielding shell and a second shielding shell. The receptacle housing defines a plurality of first cavities therein and has a first base. Two first sidewalls protrude upward from two opposite ends of the first base and two second sidewalls protrude upward from two opposite sides of the first base. A first recess is defined among the first and the second sidewalls and communicates with the first cavities. The first terminals are received in the respective first cavities. The first shielding shell is mounted to the first sidewall and is adapted to be soldered with the female printed circuit board. The second shielding shell is mounted to the second sidewall and contacts with the first shielding shell, wherein the first and the second shielding shells are configured to surround the first terminals. The plug is adapted to be mounted to the male printed circuit board and has a plug housing, a plurality of second terminals and a third shielding shell. The plug housing is received in the first recess of the receptacle housing. The plug housing defines a plurality of second cavities for receiving the second terminals. The third shielding shell is mounted to the plug housing and is adapted to be soldered with the male printed circuit board. The third shielding shell contacts with the second shielding shell.

As described above, when the board-to-board connector assembly transmits the high-frequency or the high-speed signals, some electromagnetic interference signals generated thereby are completely transmitted into the female and the male printed circuit boards and ground. Thus, an electromagnetic shielding effectiveness is acquired, and in turn, the credible signal transmission between the female and the male printed circuit boards is realized.

BRIEF DESCRIPTION OF THE DRAWING

The present invention will be apparent to those skilled in the art by reading the following description of an embodiment thereof, with reference to the attached drawings, in which.

DETAILED DESCRIPTION OF THE PREFERRED EMBODIMENT

Figure 1:
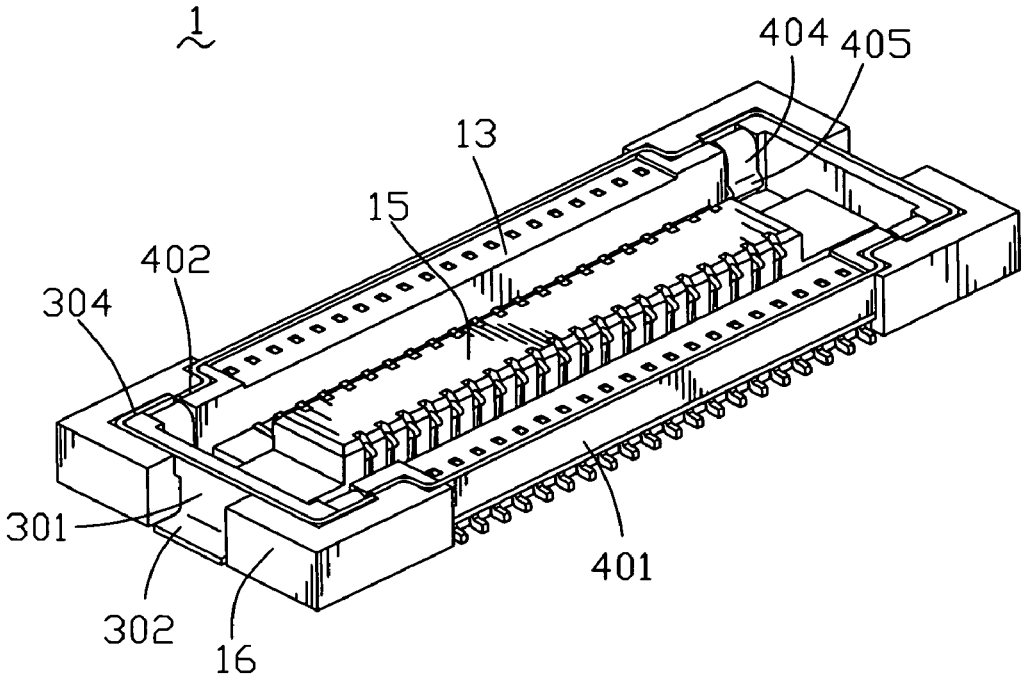
FIG. 1 is a perspective view of a receptacle of a board-to-board connector assembly in accordance with the present invention.
Figure 4:
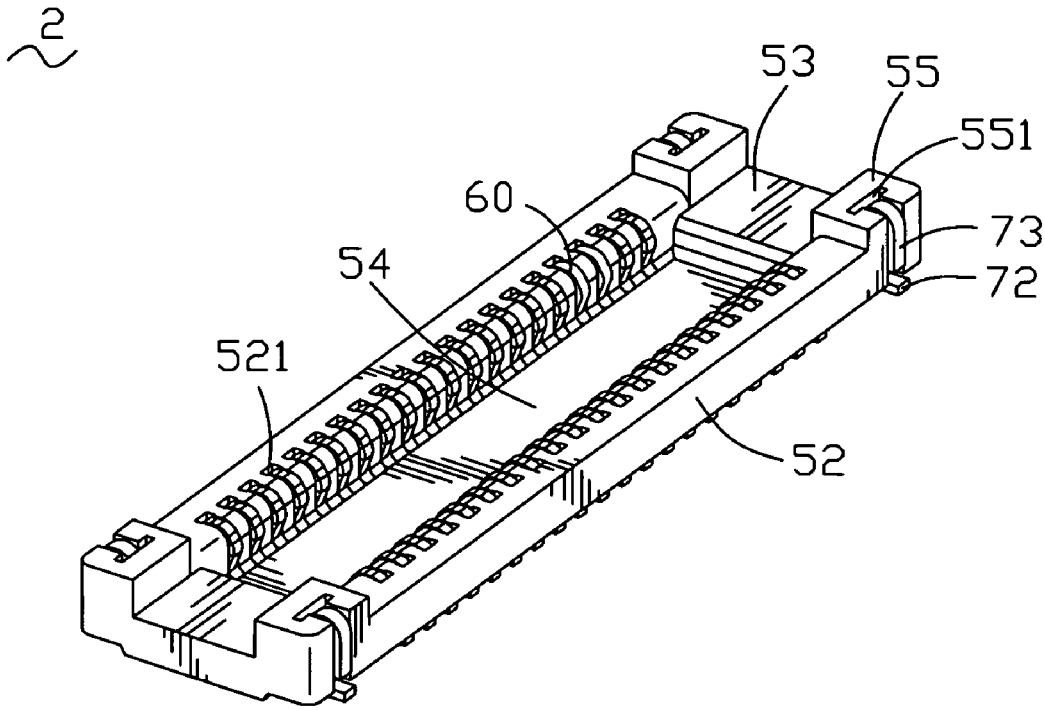
FIG. 4 is a perspective view of a plug of the board-to-board connector assembly.
Figure 7:
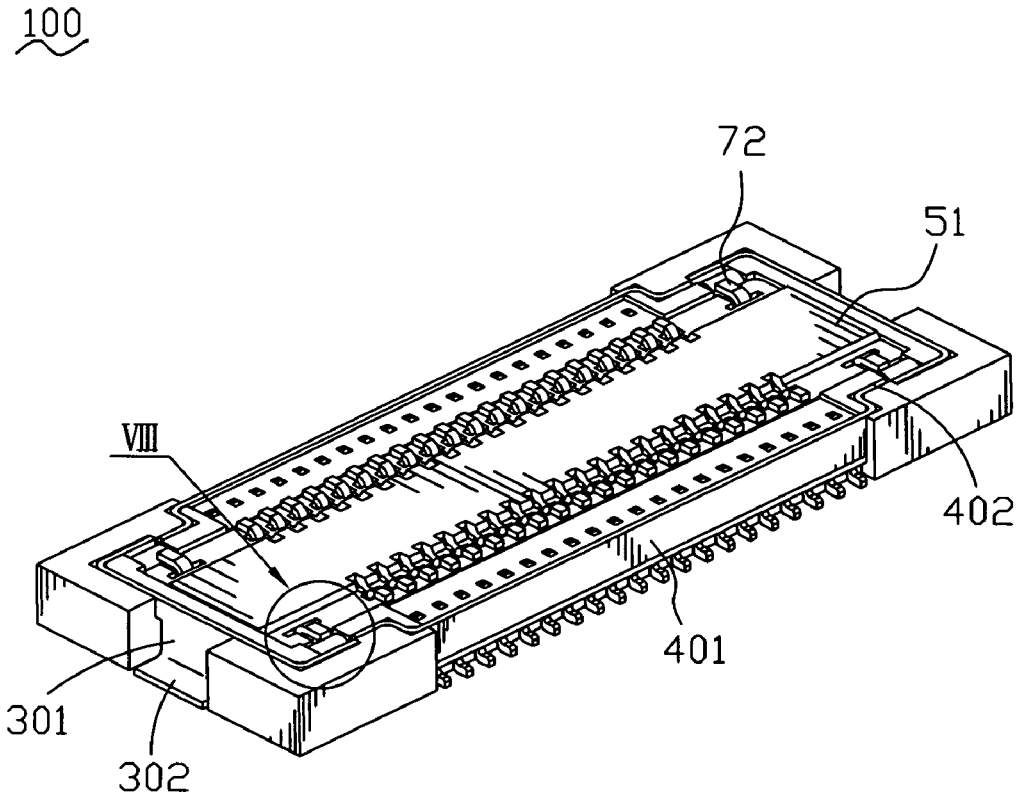
FIG. 7 is a perspective view of the board-to-board connector assembly in accordance with the present invention.

Referring now to FIG. 1, FIG. 4 and FIG. 7, a board-to-board connector assembly 100 in accordance with the present invention is composed of a receptacle 1 and a plug 2 which are mounted to a pair of spaced parallel printed circuit boards (not shown) to electrically interconnect the printed circuit boards.

Figure 2:
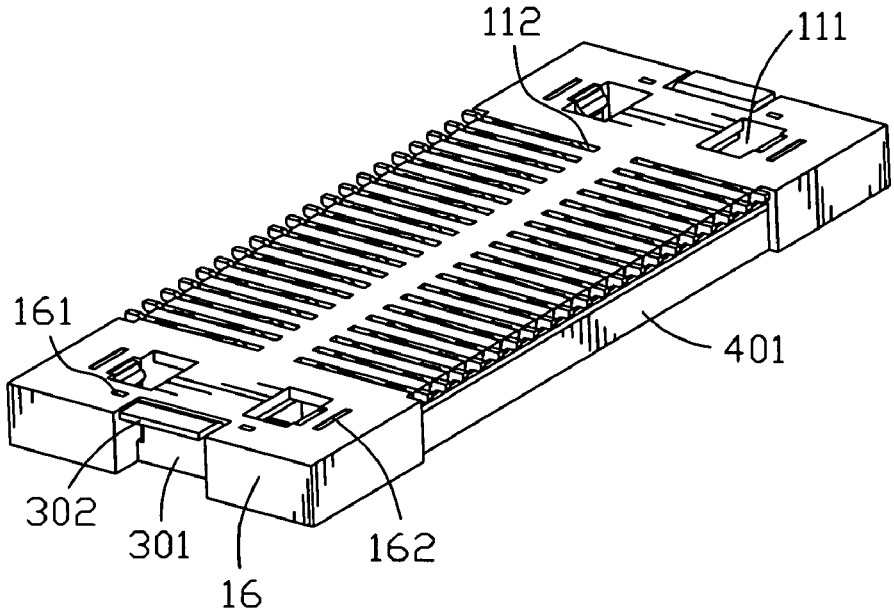
FIG. 2 is another angle perspective view of the receptacle of the board-to-board connector assembly.
Figure 3:
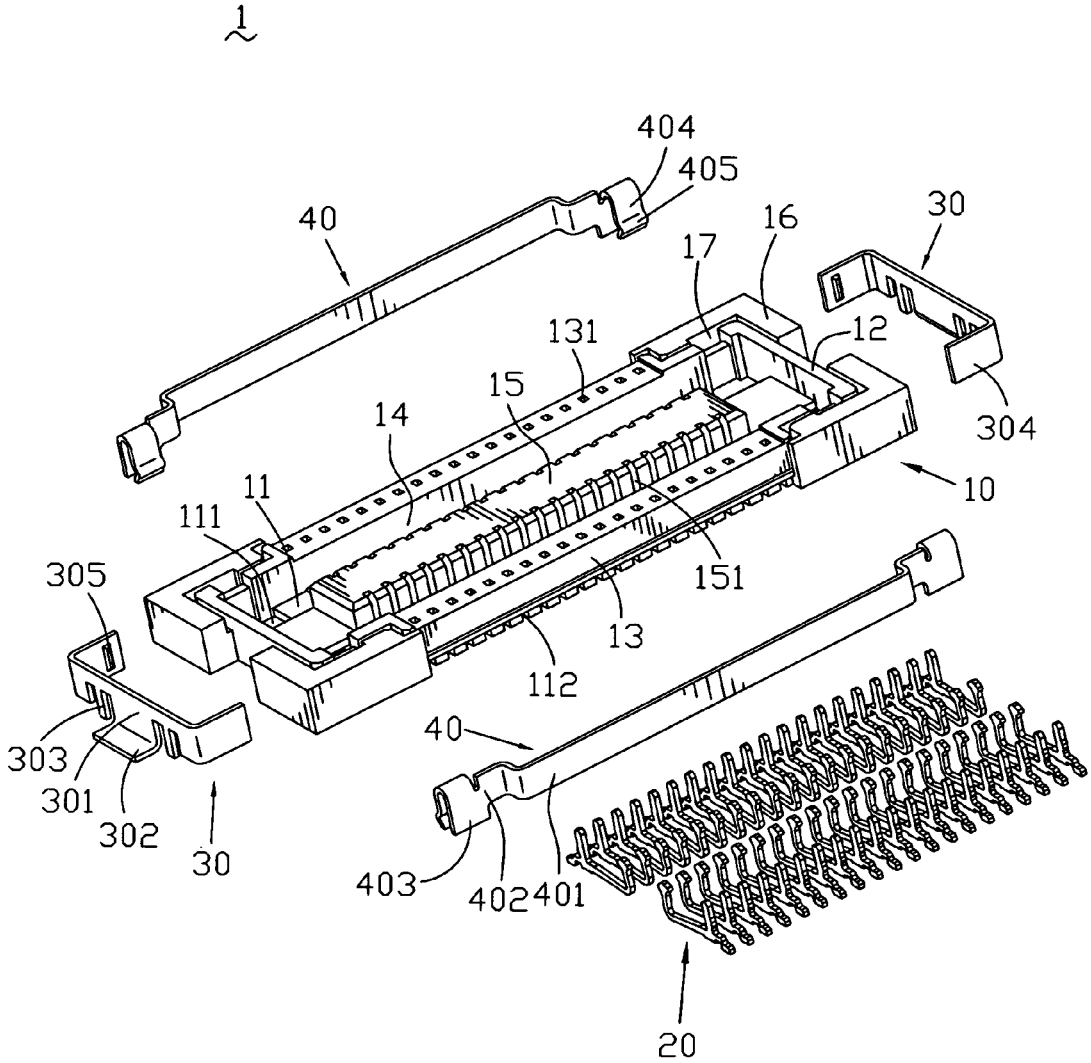
FIG. 3 is an exploded perspective view of the receptacle of the board-to-board connector assembly.

Referring to FIGS. 1, 2 and 3, the receptacle 1 includes a receptacle housing 10, a plurality of first terminals 20, a pair of first shielding shells 30 and a pair of second shielding shells 40 received in the receptacle housing 10 respectively.

The receptacle housing 10 is of a rectangular configuration to have a first base 11. Two opposite ends of the first base 11 protrude upward to form a pair of first sidewalls 12, two opposite sides of the first base 11 protrude upward to form a pair of second sidewalls 13 extending longwise. A first recess 14 is defined among the first sidewalls 12 and the second sidewalls 13. The middle of the first base 11 protrudes upward into the first recess 14 to form a rib 15 extending longwise. Two ends of the rib 15 are apart from the corresponding first sidewalls 12. Four corners of the first base 11 are cut off to respectively form a rectangular locking space 111 communicating with the first recess 14. Two sides of the first base 11 define a plurality of first cavities 112 arranged at regular intervals along a longwise direction and communicating with the first recess 14. Two opposite sides of the rib 15 vertically define a plurality of perforations 151 connecting with the respective first cavities 112 and communicating with the first recess 14. The second sidewall 13 defines a plurality of apertures 131 vertically penetrating the second sidewall 13 and connecting with the respective first cavities 112. Four L-shaped supporting portions 16 respectively encircle four corners of the receptacle housing 10. The bottom of the supporting portion 16 connects with the bottom of the corresponding corner of the receptacle housing 10 and a channel 17 is defined between the supporting portion 16 and the corresponding corner at the top. The supporting portion 16 vertically defines a first hole 161 adjacent to the first sidewall 12 and a second hole 162 adjacent to the second sidewall 13. The first hole 161 and the second hole 162 penetrate the bottom of the supporting portion 16 and communicate with the channel 17.

The first shielding shell 30 has a base plate 301 extending transversely. The middle of the bottom of the base plate 301 extends and then bends toward one side to form a first soldering section 302. The bottom of the base plate 301 extends downward to form two fixing sections 303 located near two sides of the first soldering section 302 respectively. Two opposite ends of the base plate 301 bend toward the other side opposite the first soldering section 302 and then extend to form a pair of arms 304 facing to each other. The inside of the arm 304 defines a first contact section 305.

The second shielding shell 40 has a bar plate 401 extending longitudinally. Two opposite ends of the bar plate 401 bend inward and then extend opposite to each other to form an L-shaped connecting section 402 respectively. The bottom of a free end of the connecting section 402 extends downward to form a flange 403, and the top thereof bends inward and then extends downward to form an elastic section 404. A second contact section 405 protrudes outward from the bottom of the elastic section 404.

When the receptacle 1 is assembled, the first terminal 20 is received in the corresponding first cavity 112, the corresponding perforation 151 and the corresponding aperture 131. The first shielding shell 30 is mounted to the outside of the first sidewall 12. The base plate 301 and the arms 304 are received in the corresponding channel 17 and the first soldering section 302 is received between two corresponding ends of the corresponding supporting portions 16. Accordingly, the fixing section 303 is inserted into the first hole 161. The bar plate 401 of the second shielding shell 40 is mounted to the outside of the second sidewall 13 to wrap the first terminals 20. The connecting section 402 is received in the corresponding channel 17. The elastic section 404 and the second contact section 405 stretch into the first recess 14. The flange 403 is inserted into the second hole 162. The first contact section 305 of the first shielding shell 30 abuts against the outside of the connecting section 402 of the second shielding shell 40.

Figure 5:
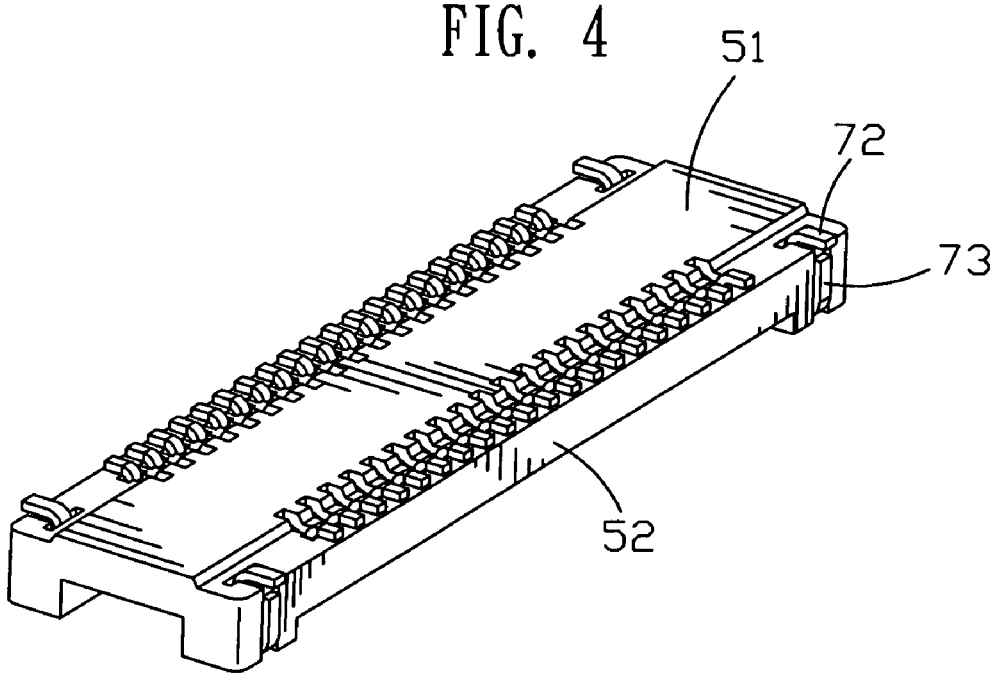
FIG. 5 is another angle perspective view of the plug of the board-to-board connector assembly.
Figure 6:
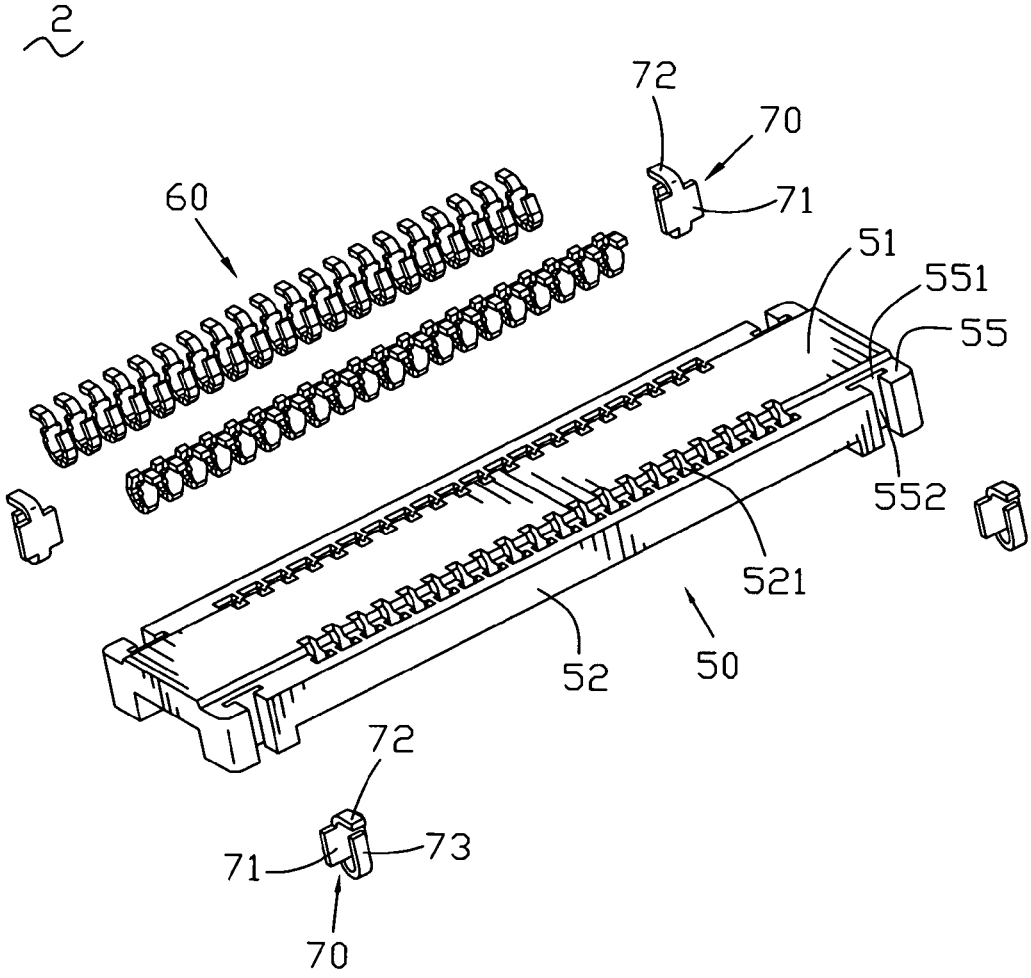
FIG. 6 is an exploded perspective view of the plug of the board-to-board connector assembly.

Referring to FIGS. 4, 5 and 6, the plug 2 includes a plug housing 50 mating with the receptacle housing 10, a plurality of second terminals 60 and four third shielding shells 70 received in the plug housing 50 respectively.

The plug housing 50 is of a rectangular configuration to have a second base 51. Two opposite sides of the second base 51 protrude downward to form a pair of third sidewalls 52 extending longwise. Two opposite ends of the second base 51 protrude downward to form a pair of endwalls 53. Accordingly, a second recess 54 mating with the rib 15 of the receptacle housing 10 is surrounded by the third sidewalls 52 and the endwalls 53. The inside of the third sidewall 52 defines a plurality of second cavities 521 arranged along a longwise direction. The second cavity 521 penetrates the top and the bottom of the third sidewall 52 and communicates with the second recess 54. Two ends of the third sidewall 52 define a pair of rectangular locking blocks 55 protruding a little downward. The locking block 55 longitudinally defines a locking slot 551 penetrating from top to bottom. The middle of the locking slot 551 transversely extends outward to form a locking groove 552 communicating with the outside.

The third shielding shell 70 has a fixing plate 71 extending longitudinally. The middle of the top of the fixing plate 71 bends toward one side and then extends to form a second soldering section 72. The middle of the bottom of the fixing plate 71 bends toward the same side with the second soldering section 72 and then extends upward to form a third contact section 73 apart from the second soldering section 72.

When the plug 2 is assembled, the second terminal 60 is received in the corresponding second cavity 521 of the plug housing 50. The third shielding shell 70 is configured in the corresponding locking block 55. The fixing plate 71 is received in the locking slot 551. The second soldering section 72 protrudes out from the top of the locking groove 552. The third contact section 73 is received in the locking groove 552 and protrudes out a little from the outside of the locking block 55.

Figure 8:
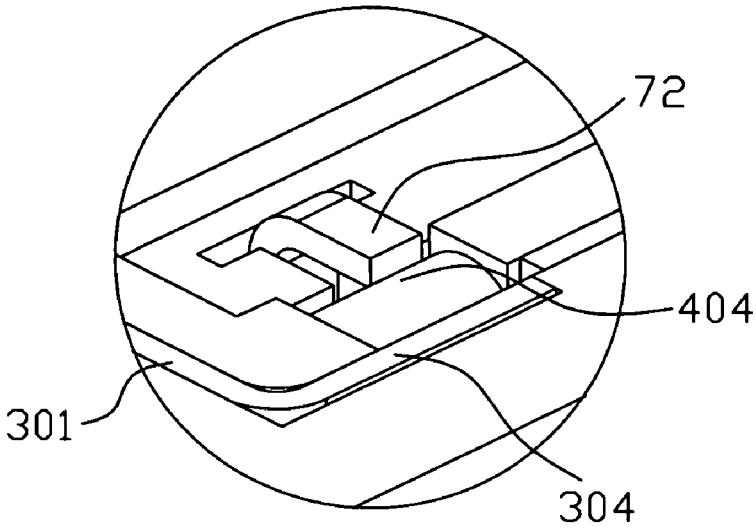
FIG. 8 is an enlarged view of an encircled portion VIII of FIG. 7.
Figure 9:
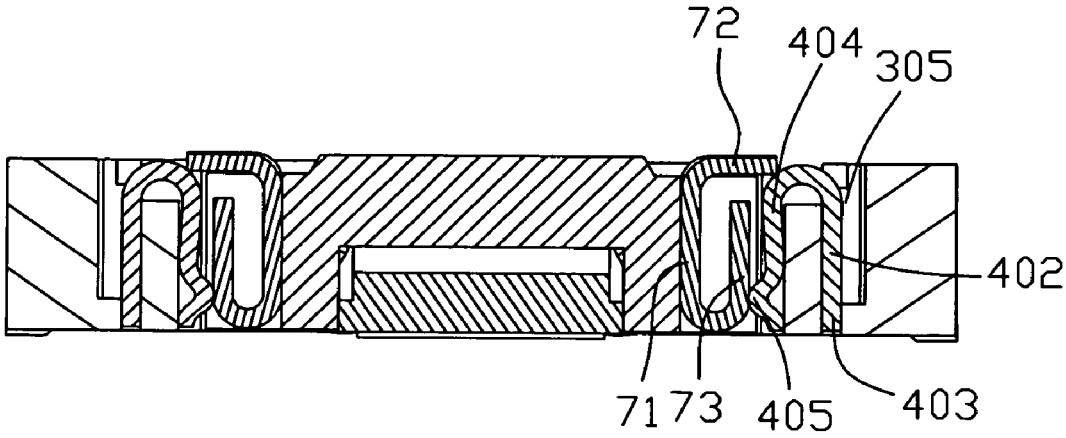
FIG. 9 is a cross-sectional view of the board-to-board connector assembly of FIG. 7.

Please referring to FIGS. 7, 8 and 9, when the plug 2 engages with the receptacle 1, the plug 2 is received in the first recess 14 of the receptacle 1. The rib 15 of the receptacle 1 is inserted in the second recess 54 of the plug 2. The bottom of the locking block 55 of the plug 2 is locked in the corresponding locking space 111 of the receptacle 1. Thus the receptacle 1 and the plug 2 engage with each other firmly. Meanwhile, the first terminal 20 steadily electrically interconnects with the corresponding second terminal 60. In the process of the plug 2 inserted into the receptacle 1, the third contact section 73 of the third shielding shell 70 moves downward against the second contact section 405 of the second shielding shell 40 until that the second soldering section 72 abuts against the elastic section 404.

In use, the receptacle 1 and the plug 2 are respectively mounted to the corresponding printed circuit boards. The first terminal 20 of the receptacle 1 and the second terminal 60 of the plug 2 are respectively soldered to the corresponding printed circuit boards in order to electrically interconnect with the printed circuit boards. The first soldering section 302 of the first shielding shell 30 is soldered to one of the printed circuit boards. The first contact section 305 of the first shielding shell 30 abuts against the outside of the connecting section 402 of the second shielding shell 40. The second contact section 405 of the second shielding shell 40 abuts against the third contact section 73 of the third shielding shell 70. The second soldering section 72 of the third shielding shell 70 is soldered to the other printed circuit board. Therefore, a good electrical connection is acquired among the shielding shells and the printed circuit boards.

As described above, when the board-to-board connector assembly 100 transmits high-frequency signals or high-speed signals, electromagnetic interference signals generated thereby are completely transmitted into the printed circuit boards and ground. Thus, an electromagnetic shielding effectiveness is acquired, and in turn, a credible signal transmission between the printed circuit boards is realized.

What is claimed is:

1. A board-to-board connector assembly adapted for electrically interconnecting a female and a male printed circuit boards, comprising:

a receptacle adapted to be mounted to the female printed circuit board, the receptacle having:

a receptacle housing with a plurality of first cavities defined therein, the receptacle housing having a first base, two first sidewalls protruding upward from two opposite ends of the first base, two second sidewalls protruding upward from two opposite sides of the first base, and a first recess defined among the first and the second sidewalls and communicating with the first cavities, a plurality of first terminals received in the respective first cavities, a first shielding shell mounted to the first sidewall and adapted to be soldered with the female printed circuit board, and a second shielding shell mounted to the second sidewall and contacting with the first shielding shell, wherein the first and the second shielding shells are configured to surround the first terminals; and a plug adapted to be mounted to the male printed circuit board, the plug having:

a plug housing received in the first recess of the receptacle housing, the plug housing defining a plurality of second cavities, a plurality of second terminals received in the respective second cavities and contacting with the corresponding first terminals, and a third shielding shell mounted to the plug housing and adapted to be soldered with the male printed circuit board, the third shielding shell contacting with the second shielding shell.

2. The board-to-board connector assembly as claimed in claim 1, wherein the receptacle housing further has four L-shaped supporting portions respectively encircling four corners of the receptacle housing, a channel is defined between the supporting portion and the corresponding corner for securing the first and the second shielding shells.

3. The board-to-board connector assembly as claimed in claim 2, wherein the first shielding shell has a base plate extending transversely, the middle of the bottom of the base plate bends toward one side to form a first soldering section, two ends of the base plate bend toward the other side opposite the first soldering section to form a pair of arms, a first contact section is defined on the arm, the base plate and the arms are received in the corresponding channel, the first soldering section is received between two corresponding ends of the corresponding supporting portions for being soldered to the female printed circuit board, the first contact section contacts with the second shielding shell.

4. The board-to-board connector assembly as claimed in claim 3, wherein the bottom of the base plate extends downward to form two fixing sections located near the first soldering section respectively, and the supporting portions each defines a first hole communicating with the channel for receiving the corresponding fixing section.

5. The board-to-board connector assembly as claimed in claim 2, wherein the second shielding shell has a bar plate extending longitudinally and shrouding the outside of the second sidewall, two ends of the bar plate bend inward and then extend sideward to form a pair of connecting sections received in the corresponding channels to contact with the first shielding shell, the top of the connecting section bends inward and then extends downward to form an elastic section stretching into the first recess of the receptacle housing, a second contact section protrudes from the elastic section to contact with the third shielding shell.

6. The board-to-board connector assembly as claimed in claim 5, wherein the bottom of the connecting section extends downward to form a flange, and the supporting portion defines a second hole communicating with the channel for receiving the flange.

7. The board-to-board connector assembly as claimed in claim 1, wherein each end of the opposite sides of the plug housing defines a locking slot extending therethrough and also defines a locking groove extending therethrough and communicating with both the corresponding locking slot and the outside.

8. The board-to-board connector assembly as claimed in claim 7, wherein the third shielding shell has a fixing plate extending longitudinally and received in the locking slot, a middle of a top of the fixing plate bends toward one side to form a second soldering section protruding outward through the locking groove for being soldered to the male printed circuit board, a middle of a bottom of the fixing plate bends toward the same side and then extends upward to form a third contact section received in the locking groove and protruding outward from the locking groove to contact with the corresponding second shielding shell.

9. The board-to-board connector assembly as claimed in claim 1, wherein a middle of the first base of the receptacle housing protrudes upward into the first recess to form a rib extending longwise, a middle of the plug housing concaves inward to form a second recess for receiving the rib, the second cavities communicate with the second recess.

10. The board-to-board connector assembly as claimed in claim 9, wherein two opposite sides of the rib define a plurality of perforations connecting with the respective first cavities and communicating with the first recess for receiving the first terminals.

11. The board-to-board connector assembly as claimed in claim 1, wherein the second sidewall defines a plurality of apertures extending therethrough and communicating with the respective first cavities for securing the first terminals.

12. A receptacle of a board-to-board connector assembly adapted for electrically interconnecting a printed circuit board, comprising:

a receptacle housing with a plurality of first cavities defined therein, the receptacle housing having a first base, two first sidewalls protruding upward from two opposite ends of the first base, two second sidewalls protruding upward from two opposite sides of the first base, and a first recess defined among the first and the second sidewalls and communicating with the first cavities, the receptacle housing further having four L-shaped supporting portions respectively encircling four corners of the receptacle housing, a channel being defined between the supporting portion and the corresponding corner;

a plurality of first terminals received in the respective first cavities;

a first shielding shell having a base plate extending transversely, a middle of a bottom of the base plate bending toward one side to form a first soldering section for being soldered to the printed circuit board, two ends of the base plate bending toward the other side opposite the first soldering section to form a pair of arms, a first contact section being defined on the arm, the base plate and the arms being received in the corresponding channel; and a second shielding shell having a bar plate extending longitudinally, the bar plate shrouding the outside of the second sidewall, two ends of the bar plate bending inward and then extending sideward to form a pair of connecting sections received in the corresponding channels to contact with the first contact section of the first shielding shell, a top of the connecting section bending downward to form an elastic section stretching into the first recess of the receptacle housing;

wherein the first and the second shielding shells are configured to surround the first terminals.

13. The receptacle as claimed in claim 12, wherein the middle of the first base of the receptacle housing protrudes upward into the first recess to form a rib extending longwise.

14. The receptacle as claimed in claim 13, wherein two opposite sides of the rib define a plurality of perforations communicating with the respective first cavities and the first recess for receiving the first terminals.

15. The receptacle as claimed in claim 12, wherein the second sidewall defines a plurality of apertures extending therethrough and communicating with the respective first cavities for securing the first terminals.

16. The receptacle as claimed in claim 12, wherein the bottom of the base plate extends downward to form two fixing sections located near the first soldering section respectively, and the supporting portions each defines a first hole communicating with the channel for receiving the corresponding fixing section.

17. The receptacle as claimed in claim 12, wherein the bottom of the connecting section extends downward to form a flange, and the supporting portion defines a second hole communicating with the channel for receiving the flange.

* * * * *